United States Patent [19]

Kita

[11] 4,098,352

[45] Jul. 4, 1978

[54] PERCUSSION BIT WITH BYPASS CHANNEL THEREIN

[75] Inventor: John F. Kita, Bedford, Pa.

[73] Assignee: Kennametal Inc., Latrobe, Pa.

[21] Appl. No.: 751,277

[22] Filed: Dec. 17, 1976

[51] Int. Cl.[2] ..... B23Q 5/027

[52] U.S. Cl. ..... 173/17; 173/78

[58] Field of Search ..... 173/17, 18, 19, 78

[56] References Cited

U.S. PATENT DOCUMENTS

| | | | |
|---|---|---|---|
| 3,896,886 | 7/1975 | Roscoe | 173/17 |
| 3,944,003 | 3/1976 | Curington | 173/17 |
| 3,958,645 | 5/1976 | Curington | 173/17 |
| 3,986,565 | 10/1976 | Atkinson | 173/15 |

FOREIGN PATENT DOCUMENTS

| | | | |
|---|---|---|---|
| 690,685 | 6/1965 | Italy | 173/139 |

*Primary Examiner*—Robert A. Hafer

*Attorney, Agent, or Firm*—Lawrence R. Burns

[57] ABSTRACT

A percussion bit for use with a down-the-hole drilling motor having a hammer which reciprocates in the motor to impact on the upper end of the bit. The bit has a working position in the motor and an idle advanced position. When the bit is in the idle advanced position, the hammer advances to an idle position and, at that time, it is desired for the hammer merely to rest on the bit without impacting the bit. The hammer is reciprocated by fluid pressure and, according to the present invention, a bypass channel is formed directly in the bit which exhausts one of the pressure chambers for the hammer when the bit is in its advanced position.

6 Claims, 4 Drawing Figures

PERCUSSION BIT WITH BYPASS CHANNEL THEREIN

The present invention relates to down-the-hole drilling equipment, and is particularly concerned with bits for fluid operated percussion type drill motors.

In a recently issued Schindler et al. U.S. Pat. No. 3,595,323, there is shown an arrangement for bypassing a fluid pressure chamber associated with the drill motor hammer to exhaust when the hammer is in an advanced position. In the patent referred to, the exhausting of the pressure chamber is accomplished by a groove means extending along the upper end of the bit and through the striking face which is opposed to the adjacent end of the hammer with a valve arrangement provided between the bit shank and a chuck in which it is supported which is interrupted when the hammer is in working position and which is established when the hammer is in advanced position.

The aforementioned valve arrangement is interposed between the axially extending groove means and the exhaust passage leading to the atmosphere. The described arrangement provides for establishing of the exhaust passage when the piston is advanced and for the interruption thereof when the piston is retracted.

The described arrangement has, however, the defect that groove means are formed in the periphery of the upper end of the bit and extend through the striking face of the bit and, thus, form regions where the peripheral contour of the upper end of the bit is interrupted so that cracks may commence to form at the bottoms of the groove means which could lead to premature failure of the bit.

It is possible to eliminate the aforementioned grooving of the bit through the striking face thereof by the forming of special passage means in a ring element which supports the bit in the hammer when the bit is in advanced position. While such an arrangement will operate satisfactorily, it requires the use of a special ring and if, in the field, the special ring is not employed with the bit, the drawbacks of the prior art will be present in the bit and hammer combination.

Having the foregoing in mind, the primary objective of the present invention is the provision of a bit having bypass means formed therein which eliminates the need for forming groove means extending through the ring of the bit and which also eliminates the need for a special striking face in the hammer to retain the bit therein.

BRIEF SUMMARY OF THE INVENTION

According to the present invention, a down-the-hole fluid operated percussion hammer is provided with a bit in the lower end which is splined to a chuck member threaded into the lower end of the hammer and with a support ring clamped in between the upper end of the chuck member and the drill motor and which ring encircles the shank of the bit beneath a shoulder formed thereon.

The ring retains the bit in the hammer, and when the hammer is lifted so that the shoulder on the bit engages the ring to lift the motor off the bottom of the hole being drilled, the hammer in the motor is also permitted to advance in the downward direction and interrupt the supply of pressure fluid thereto. At this time, the bit and chuck together form a passage leading to exhaust and which communicates with axial grooves formed in the bit and extending through the aforementioned ring and through the end of the bit so that the chamber on the underneath side of the hammer is exhausted thereby preventing the hammer from impacting on the bit and possibly causing damage.

The exact nature of the present invention will become more clearly apparent upon reference to the following detailed specification taken in connection with the accompanying drawings in which.

DETAILED DESCRIPTION OF THE INVENTION

Figure 1:
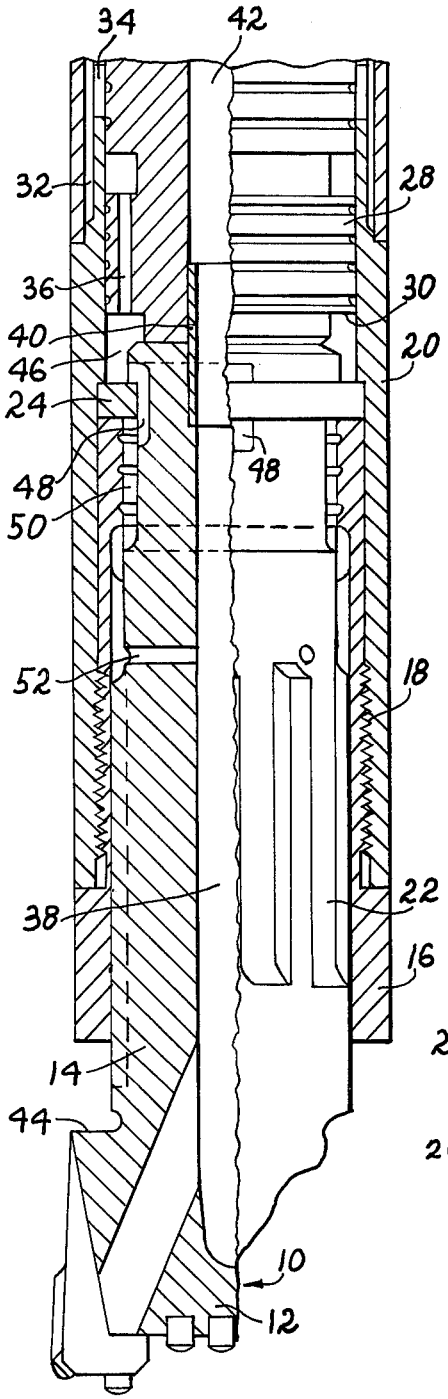
FIG. 1 is a fragmentary view showing the lower end of a down-the-hole fluid pressure operated percussion drilling motor and a bit according to the present invention mounted therein in advanced idle position.

Referring to the drawings somewhat more in detail, the bit 10 shown therein has a working portion 12 at the lower end provided with hard wear resistant inserts and somewhat larger in diameter than the axially upwardly extending shank portion 14 of the bit. Shank portion 14 is receivable in a chuck 16 threaded at 18 into the lower end of casing 20 of a down-the-hole hammer. Spline means indicated at 22 nonrotatably connect the bit and chuck while permitting axial movement of the bit in the chuck.

At the upper end of chuck 16, there is a split ring 24, the lower side of which engages the upper end of the chuck while the upper side is engaged by a downwardly facing shoulder formed in casing 20 of the motor. The bit shank 14 extends through ring 24 and has a flange or shoulder 26 formed thereon above the ring so that the hammer can be moved between its idle position of FIG. 1 to its working position of FIG. 2 without difficulty.

The upper end of the bit shank is adapted for being engaged by a hammer 28 reciprocable in the drilling motor and having a downwardly facing surface 30 adapted for being supplied with pressure fluid from a pressure passage 32 formed in the casing of the motor and a port 34 opening into the central cavity of the motor and which hammer 28 is reciprocable. A further passage means 36 is provided in the hammer itself to connect lower working face 30 with the pressure supplied.

The bit has a central passage 38 leading to the atmosphere and at the upper end communicating with a valve tube 40 which is slidably receivable in central bore 42 extending axially completely through hammer 28.

In operation, when the casing 20 of the hammer is set downwardly so the lower end of the casing engages the upwardly facing shoulder 44 near the lower end of the bit, pressure fluid will alternately be supplied to the opposite ends of hammer 28 and drive it in reciprocation in the casing and cause the hammer to impact against the upper end of bit 10.

As long as pressure fluid is supplied to the upper end of the drill motor, the hammer will continue to reciprocate and impact the bit. However, when the casing of the drill motor is raised upwardly to its FIG. 1 position, the bit will hang on ring 24 as illustrated and the hammer will advance downwardly and cover ports 34 thereby interrupting the supply of air to the lower working surface 30 of the hammer. At this time, it is desired for the chamber 46, of which surface 30 forms the upper side, to be exhausted to prevent the hammer from striking against the upper end of the bit and causing possible damage to the bit and chuck and support ring 24.

The applicant accomplishes the exhausting of chamber 46 by undercuts 48 formed in that region of the bit in which ring 24 is disposed when the casing of the drill is in its FIG. 1 position. It will be noted that any pressure fluid in chamber 46 can pass downwardly through passage means 48, of which there may be several, and exhausted to atmosphere by exhaust passage means which may include channels formed by space 50 between the inside of chuck 16 and the outer periphery of bit 10 and then either radially inwardly drilled passages 52 into central passage 38 in the bit or outwardly passages formed through the bottom of one or more of the recesses forming a part of the spline structure of the bit.

Figure 2:
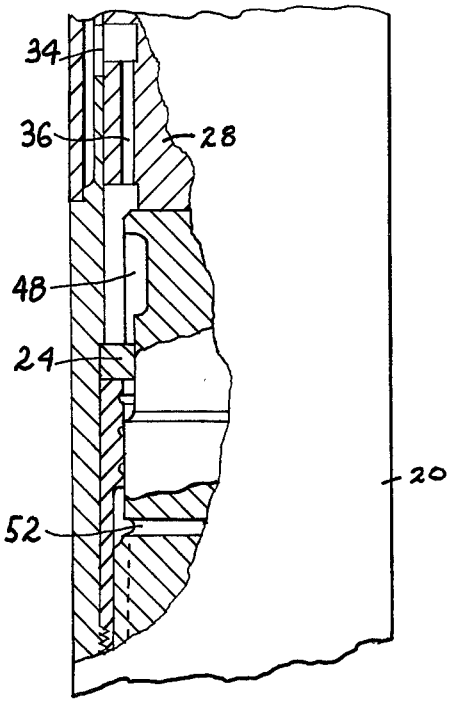
FIG. 2 is a view similar to FIG. 1 but showing the bit in working position.
Figure 4:
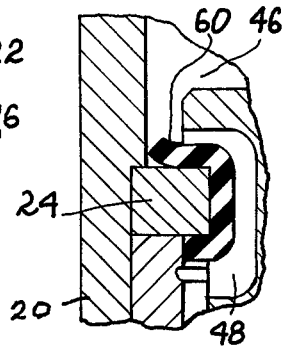
FIG. 4 is a fragmentary view showing a further modification.

It will be noted that when the bit is in working position in the casing, as shown in FIG. 2, the notches or recess means 48 are completely above ring 24 while, at the same time, the space 50 is interrupted by overlapping regions of the bit and chuck thereby further inhibiting any loss of pressure from the chamber on the underside of the hammer.

Figure 3:
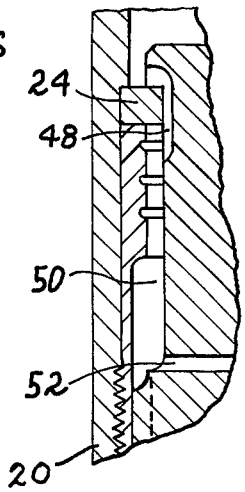
FIG. 3 is a fragmentary view showing a portion of the bit and motor and illustrating a modification.

It will be apparent that substantially all of the valving between atmosphere in the chamber beneath the hammer, when the bit moves from idle position to working position, can be accomplished by ring 24 so that, as shown in FIG. 3, the space 50 between the bit and the shank can be continuously connected with the atmosphere and no substantial loss of fluid from the underneath side of the hammer via passage 50 will occur.

As has been mentioned, ring 24 is a split ring and there can be some loss of fluid through the juncture of the ring parts. This can be prevented, according to the present invention, by the provision of an annular seal ring 60 in which ring 24 seats. The seal ring, which may be formed of Teflon or the like, does not inhibit movement of the bit within the ring as the bit moves between working and idle positions, but it does effectively seal against loss of fluid through the ring except when the notch or recess means 48 is in position to effect exhausting of chamber 46 which is beneath the hammer 28.

Modifications may be made within the scope of the appended claims.

What is claimed is:

1. In a bit for mounting in the lower end of a percussion drill for reciprocal movement therein between a lower idle and an upper working position, said drill having a casing forming a working chamber with the upper end of the bit and a hammer reciprocable in the casing for impacting the upper end of the bit; said bit having an upwardly facing shoulder near the lower end which engages the lower end of the casing when the bit is in working position and a flange forming a downwardly facing shoulder near the upper end which engages a split ring in the casing when the bit is in idle position, and means for exhausting said working chamber when the bit is in idle position comprising axial recess means formed in the side of said bit and terminating in closed ends which are disposed on opposite sides of said split ring when said bit is in idle position and on the same side of said split ring when said bit is in working position, and exhaust passage means leading from the underside of said ring to the atmosphere when said bit is in idle position.

2. A bit according to claim 1 which includes a seal sealing between said ring and said bit when the bit is in working position.

3. A bit according to claim 1 which includes an annularly outwardly opening seal ring in which said split ring is mounted.

4. A bit according to claim 1 in which the upper closed end of each recess means is disposed in the axial range of said flange so as to avoid radial recesses forming interruptions of the contour of the upper end of the bit.

5. A bit according to claim 1 in which said exhaust passage means includes an annular region surrounding said bit on the underneath side of said ring and in continuous communication with the atmosphere.

6. A bit according to claim 1 in which said exhaust passage means includes an annular region surrounding said bit on the underneath side of said ring and means effecting communication of said region with the atmosphere when the bit is in idle position and effecting cut off of the region from the atmosphere when the bit is in working position.

* * * * *